United States Patent [19]

Cicero

[11] 3,989,256

[45] Nov. 2, 1976

[54] GOLF CLUB

[76] Inventor: Edward Cicero, 52-62 66th St., Maspeth, N.Y. 11378

[22] Filed: Apr. 6, 1971

[21] Appl. No.: 131,632

[52] U.S. Cl. ..... 273/167 J; 273/194 A

[51] Int. Cl.[2] ..... A63B 53/08

[58] Field of Search ..... 273/77 R, 78, 80 C, 273/163 R, 163 A, 164, 167–175, 186 A, 193 R, 194 A

[56] References Cited

UNITED STATES PATENTS

| | | | |
|---|---|---|---|
| 1,291,967 | 1/1919 | McDougal | 273/163 R |
| 1,337,958 | 4/1920 | Reach | 273/175 |
| 1,441,492 | 1/1923 | Dwight | 273/163 R X |
| 3,085,804 | 4/1963 | Pieper | 273/167 B X |
| 3,333,854 | 8/1967 | White | 273/167 B X |
| 3,384,376 | 5/1968 | Greenlee | 273/167 C X |
| 3,437,341 | 4/1969 | Hasten et al. | 273/168 X |
| 3,489,415 | 1/1970 | Smith | 273/163 R X |
| D55,278 | 5/1920 | Kraeuter | 273/167 J UX |
| D188,280 | 6/1960 | Branch | 273/167 C UX |

FOREIGN PATENTS OR APPLICATIONS

| | | | |
|---|---|---|---|
| 7,550 | 4/1900 | United Kingdom | 273/175 |
| 27,807 | 12/1911 | United Kingdom | 273/175 |
| 325,744 | 2/1930 | United Kingdom | 273/164 |

*Primary Examiner*—Richard J. Apley

[57] ABSTRACT

A golf club which is composed of a shaft and attached to the shaft a head member having a limited area elevated striking surface disposed on a lateral face of the head member and adapted to reduce error due to mishitting, to improve concentration, to obtain consistently solid putting and to produce normal spin, overspin, or underspin in a golf ball without varying the normal golf stroke of the player.

1 Claim, 12 Drawing Figures

INVENTOR.
EDWARD L. CICERO
BY Philip T. Shannon

GOLF CLUB

BACKGROUND OF THE INVENTION

1. Field of the Invention

This invention relates to golf clubs which have a limited area elevated striking surface on a lateral face of the head of the club. More particularly, this invention relates to a golf club having a limited area elevated striking surface which is adapted to reduce hitting errors, provide solid consistent putts and to impart desired control of the spin of the golf ball.

2. Description of the Prior Art

The golf club which is used by the golfer on the green or putting surface is, not surprisingly, known as a putter. There are two distinct kinds of putters currently in use by golfers. One is the mallet putter and the other is the blade putter. The difference between the two putters is simply that the mallet putter has a greater profile than the blade putter. In other words, the distance from the front of the putter's striking surface to its rear surface is greater in a mallet putter. However, the area of the striking faces of the mallet and blade putters do not significantly differ from one golf club to another. The area of the striking surfaces of these prior art putters, in fact, are in many cases only slightly less than that of other golf clubs which are used for golf shots at a great distance from the green which require contacting the golf ball with the club head with a far greater velocity than is required to properly stroke the golf ball with a putter. For example, the velocity of the number one wood or driver at impact is from up to 150 miles per hour.

Despite the fact that there is available to the golfer substantially the same amount of club face in which to hit the golf ball with his putter as there is to hit the golf ball with the driver or other wood club, putts are generally mishit. It is remarkable that this should be true when one considers that the putter is used on a putting green that ideally is a carefully prepared and manicured flat grass surface so that there is usually a smooth path from the golf ball to the target cup to which the golfer must direct the ball; that the surface of the putting green also usually allows the golfer to assume the stance that is most comfortable to him; and that the distances involved are far shorter than any other golf shot.

The frequency with which putts are missed is also surprising because the putter is utilized more than any other club in the golfer's bag and in fact accounts for more than half of the strokes required by par on the average golf course.

In addition to the flat and relatively large striking surfaces of prior art putters, the top of the putter heads used heretofore usually have line-up marks which indicate to the golfer the center of gravity of the putter system, i.e., the point at which impact should occur between the putter head and the golf ball to obtain a true hit. The problem with such large-faced putters with their line-up markers is that they tend to lower the golfer's degree of concentration in that the golfer not improvidently believes that the chances of seriously mishitting the golf ball resting on the putting green are far less than anywhere else on the golf course. This relaxation of concentration, however, has led many golfers to unconsciously move or roll their hands forward of the putter head during the putting stroke which results in decreasing the angle of the putter face to the putting green to an angle below the desired 90° angle at the point of impact with the golf ball. As a result, the upper part of the striking surface of the putter head leads the rest of the putter into the impact zone and hits the golf ball above the ball's center of gravity thus producing an overspin on the ball and a faster roll to the cup than was intended or which would have been produced if the ball had been hit squarely at its center of gravity. Golf balls hit in this fashion usually overshoot the cup. Similarly, the golfer is apt to unconsciously roll his hands away from the ball thus increasing the angle of the putter face to the putting green above the desired 90° angle at the point of impact with the golf ball. Consequently, the lower part of the putter face tends to hit the golf ball below the ball's center of gravity. Hitting on the golf ball in this manner will tend to produce a back spin on the golf ball and cause the ball to roll more slowly to the cup than if hit squarely through the center of gravity of the golf ball. The golf ball thus invariably fails to reach the cup.

It is also a common fault of golfers to unwittingly play the golf ball too close to their left or right foot. In other words, golfers sometimes assume an improper stance which results in a tendency to hit the golf ball on the down stroke and above the center of gravity of the golf ball or on the up stroke and below the center of gravity of the golf ball. Thus, the effect is the same as when the golfer decreases or increases the angle of the putter face because it results in either hitting the golf ball above or below its center of gravity with concomitant imparting of forward or reverse spin to the golf ball.

Another common cause of mishit putts is the tendency of many golfers to lift their heads to see where the golf ball is going before completing the putting stroke. Due to the fact that the golfer has raised his head before completely hitting the golf ball, the golfer invariably also raises the putter face before hitting the golf ball. The result is that the golfer fails to hit the golf ball through the center of gravity of the putter system or "tops" the golf ball. Despite the fact that hitting the golf ball in this manner produces some forward or overspin in the golf ball, the resultant putt is a weak one and the ball does not travel as far as was intended by the golfer.

SUMMARY OF THE INVENTION

I have found that the consequences of many of the common errors of a golfer in putting can be alleviated and reduced if not eliminated. In accordance with the teachings of the present invention there is provided a golf putter having a novel putter face which eliminates or reduces the incidence of mishit putts which are caused by the golfer's failure to assume the proper stance or to maintain the proper positioning and control of his hands, head and body during the execution of the putting stroke. The present invention not only is a defense to the golfer whereby the consequence of mishit putts are minimized it also gives the golfer the capability to control the spin on the golf ball. It therefore enables a golfer to cope with a downhill putt by giving a reverse or backspin so that it won't run past the cup. In addition, the putter of the present invention enables the golfer to more effectively cope with long or uphill putts by giving the golf ball an overspin to insure that the golf ball will have a positive forward roll to the cup. Broadly stated, the improved golf club of the present invention comprises a shaft and a head member which has a limited area elevated striking surface disposed on a side surface of the club head. The limited area elevated striking surface extends or protrudes laterally from the base of the side surface of the club head. In one preferred embodiment of the present invention, the limited area striking surface is disposed transversely across a side surface of the club member, parallel to the upper and lower edges of said side surface. In another preferred embodiment the limited area elevated striking surface of the golf club has linear surface edges and is disposed diagonally across a side surface of the head member.

My golf club has many advantages over putters of the prior art. For example, due to the fact that it presents a substantially smaller striking surface which protrudes laterally from the base of the frontal surface of the putter head, the impact of the golf ball on the putter is normally through the center of gravity of the putter system despite the fact that the golfer may involuntarily lift his putter face above the correct hitting level through improper body control or improper stance. And although the golf ball is not struck squarely through its center of gravity, the fact that the ball is hit solidly above its center of gravity results in augmenting forward spin as the ball rolls towards the cup thereby considerably reducing the consequences of an otherwise misplayed putt. The size of the striking area of the putters that have been used heretofore has been detrimental to good impact between the putter's striking surface and the golf ball because it is fairly difficult to maintain a putter face having a substantial vertical dimension in a vertical plane at the point of impact with the golf ball. However, when the vertical dimension of the striking surface is quite small or narrow as in the putter face of the present invention, the same error will produce a smaller deviation from impact at the center of gravity of the ball and consequently results in more consistently solidly hit putts.

The problems which the present invention have eliminated and reduced should be distinguished from those problems which are caused when the golfer either does not align his stance at right angles to the intended path of the ball or, in a proper stance, nevertheless pushes the ball to the right of the cup or pulls it to the left of the cup. In such cases, the golf ball is hit squarely but the direction of the golfer's swing is out of line with the intended path of the ball. The present invention is concerned with the difficulties that arise despite the fact that the golfer's swing or putting stroke is in perfect alignment with the intended path of the golf ball to the cup.

DESCRIPTION OF THE PREFERRED EMBODIMENT

Figure 1:
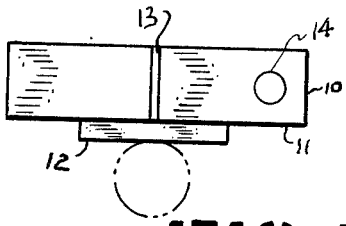
FIG. 1 is a top plan view of a generalized putter head having a limited area striking surface whose length is not coextensive with that of the putter face.
Figure 2:
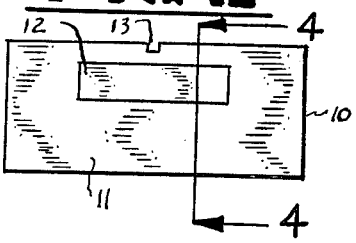
FIG. 2 is a front elevational view of a generalized putter head having a rectangular elevated striking surface.
Figure 3:
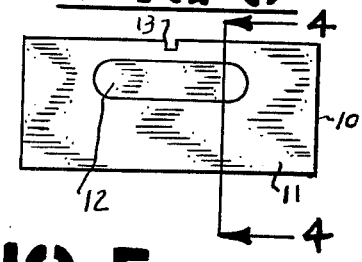
FIG. 3 is a front elevational view of a generalized putter head having a curved elevated striking surface.
Figure 4:
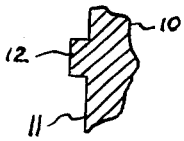
FIG. 4 is a cross sectional view taken along line 4—4 of FIG. 2 and FIG. 3 showing one of the numerous profiles possible with the limited area striking surface.

Referring to FIG. 1, it can be seen that the club head includes a head member 10, a side surface 11 on which is disposed a limited area elevated striking surface 12, a line-up marker 13 and a club shaft socket 14. Striking surface 12 will normally be flat and formed at a 90° angle to the vertical plane. However, striking surface 12 could be upwardly or downwardly inclined. It is also unnecessary that its surface be flat. It could be rounded or pointed or a number of other configurations. The entire club member can be cast in this fashion or advantageously the limited area protruding striking surface could be arranged on a clip (not shown) for easy attachment to the golfer's present golf club. The clip assembly could advantageously be constructed of resilient vinyl resin or of any suitable metal. Alternatively, a putter head could be provided with grooves in its face and the various striking surfaces of the present invention inserted therein to meet the particular problem at hand.

The various embodiments of FIGS. 1–12 are exemplitive of the variety of configurations into which the limited area elevated striking surface can advantageously be formed. Thus, the limited area elevated striking faces 12 of FIGS. 2 and 3 would be used by the golfer when he is confronted with a long or uphill putt and he wishes to impart a forward spin to the ball and avoid having the ball stop short of the lip of the cup. The central circular portion 17 of elevated striking surface 12 of FIG. 7 would be useful to the golfer when he is confronted with a medium sized (7–15 feet) shot on a level portion of the green. In that instance, a golfer normally prefers that his ball roll to the cup with average spin. It should be noted that whatever limited area elevated striking surface is selected by the golfer, the reduced area of the striking surface of the present invention constrains the golfer to concentrate and make certain to contact the golf ball with precise area of club head 10 in which the elevated striking surface selected is located. This factor advantageously minimizes the change that a putt will be mishit through the relaxed inadvertence of a golfer who is persuaded that a large striking surface permits him to stroke the golf ball with any part of his putter face.

Figure 6:
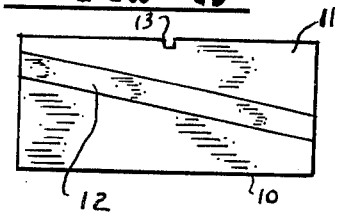
FIG. 6 is a front elevational view of a generalized putter head having a rectilinear elevated striking surface disposed diagonally across the putter face.
Figure 7:
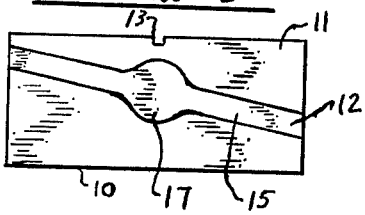
FIG. 7 is a front elevational view of a generalized putter head showing an alternative embodiment of the elevated striking surface having an enlarged central portion.

In FIGS. 6 and 7 the striking surface is continuous across the putter face and presents a continuous symmetrical view to the golfer looking down upon it. At the toe-end of the golf club, the striking surface is located in the upper quadrant of the putter face such that the vertical distance above the bottom of the club head is equal to the vertical distance equivalent to the center of gravity of a conventional golf ball at the center of the putter face. Thus, all contact at the toe-end will be above the golf ball's center of gravity, and as the striking surface slopes into the lower heel-end quadrant, all impact with the golf ball will be below the golf ball's center of gravity.

Figure 8:
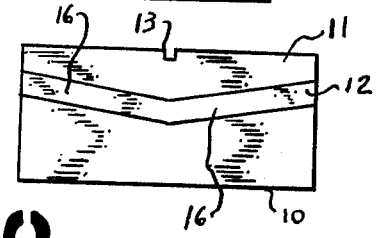
FIG. 8 is a front elevational view of a generalized putter head showing a further alternative embodiment of the elevated striking surface in which dual canted elements intersect to form a V pattern.
Figure 9:
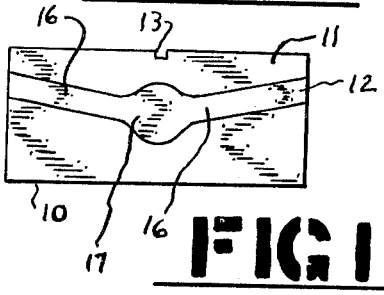
FIG. 9 is a front elevational view of a generalized putter head showing a further alternative embodiment of the elevated striking surface in which the V pattern incorporates an enlarged central portion.

For example, in FIG. 7, if a golfer is confronted with a short downhill putt which he wishes to strike affirmatively without causing the ball to run past the cup, he will address the ball more closely so that the ball is struck by lower segment 15 of limited area striking surface 12. Since lower segment 15 will strike the golf ball below the center of gravity of the golf ball, it will produce a reverse spin on the ball. In this manner, the golfer does not have to fear that if he hits the ball with any force, it will roll a great distance beyond the hole and can instead execute a delicate stroke with confidence. The striking surface of FIG. 9, in addition to providing the basic benefits which accrue from a striking surface with a limited vertical dimension, is designed to assist the golfer who fails to consistently stroke the golf ball through the center of gravity of the putter system, i.e., hit the ball at the line-up mark 13. Thus, when a golf ball is hit to the left or the right of the line-mark 13 with the elevated striking surface 12 depicted in FIG. 9, upper segments 16 of elevated striking surface 12 are positioned to impact above the center of gravity of the golf ball. In this way, there is provided automatic compensation in the form of forward spin for an off-center hit which otherwise would have been weaker than intended. The configuration of the elevated striking surface 12 in FIG. 8 is designed to function similarly to the elevated striking surface 12 of FIG. 9.

Figure 10:
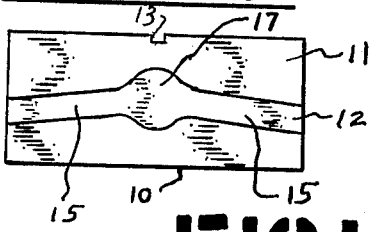
FIG. 10 is a front elevational view of a generalized putter head showing another alternative embodiment of the striking surface having downward canted elements incorporating an enlarged central position.

On the other hand, the striking surface depicted in FIG. 10 will appeal to the golfer that is consistently overly strong or prefers to stroke his putt firmly because the striking surface 12 will tend to strike the golf ball below its center of gravity creating backspin and counteract the effect of the strong or firm putting stroke.

Figure 11:
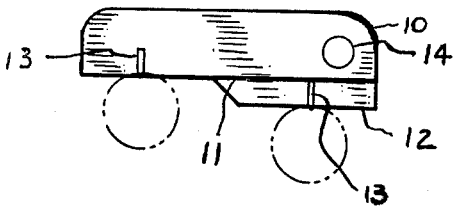
FIG. 11 is a top view of a generalized putter head having the limited area striking surface located in the quadrant of the putter face adjacent to the club shaft.
Figure 12:
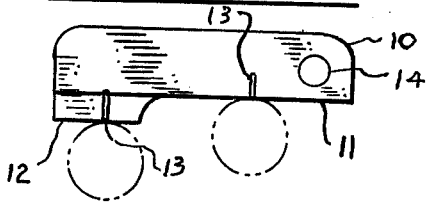
FIG. 12 is a top view of a generalized putter head having the limited area striking surface located in the quadrant of the putter face distal from the club shaft.

The putter heads depicted in limited area FIGS. 11 and 12 provide elevated striking surfaces which are not coextensive with the length of the putter face and which are situated in either the left or right quadrant of the putter face thus making approximately half of the putter face area available as an unrestricted striking surface. The portion of the putter face which is provided with a limited area elevated striking surface can of course utilize any of the configurations depicted in FIGS. 1–10. In this embodiment of the present invention, the golfer is afforded the greatest versatility on the putting green.

Figure 5:
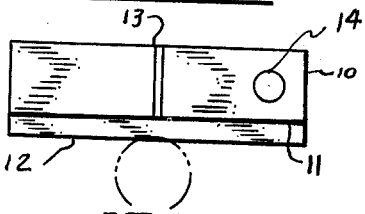
FIG. 5 is a top plan view of a generalized putter head having a limited area striking surface whose length is coextensive with that of the putter face.

FIG. 5 shows a putter head 10 which is quite like putter head 10 in FIG. 1 except that elevated striking surface 12 is continued across the entire length of the putter face and presents a symmetrical view of the putter head to the golfer.

The above description of the present invention has been made with reference to the presently preferred embodiments. However, it is to be understood that various changes can be made thereto without departing from the scope of the invention as set forth in the following claims.

I claim:

1. An improved golf club comprising a shaft and handle portion, a head member attached to the shaft, a substantially narrow rectilinear limited area elevated striking surface disposed on the lateral face of said head member, said lateral face being substantially planar, said striking surface being substantially planar and projecting a predetermined distance from and substantially parallel to the base of said lateral face, below the upper and above the lower horizontal boundaries of said lateral face, said striking surface extending intermediate the ends of said head member and continously diagonally across said lateral face from the toe end to the heel end of said head member and having a central portion located at a vertical distance above the lower horizontal boundary of said head member equivalent to the center of gravity of a conventional golf ball and having the portion of said striking surface located between said central portion and said toe end at a vertical distance above the ball's center of gravity and having the portion of said striking surface located between said central portion and said heel end at a vertical distance below the ball's center of gravity.

* * * * *